US006419099B1

(12) United States Patent
Weber

(10) Patent No.: US 6,419,099 B1
(45) Date of Patent: Jul. 16, 2002

(54) LANE DIVIDERS FOR COMMERCIAL DISPLAY REFRIGERATORS

(75) Inventor: Ronald J. Weber, Bradenton, FL (US)

(73) Assignee: Commercial Refrigerator Door Company, Inc., Sarasota, FL (US)

( * ) Notice: Subject to any disclaimer, the term of this patent is extended or adjusted under 35 U.S.C. 154(b) by 0 days.

(21) Appl. No.: 09/410,331

(22) Filed: Oct. 1, 1999

(51) Int. Cl.[7] ..... A47F 5/00

(52) U.S. Cl. ..... 211/184; 312/140.4; 108/60; 108/61

(58) Field of Search ..... 211/184, 59.2, 211/181.1, 90.03, 90.01; 108/60, 61

(56) References Cited

U.S. PATENT DOCUMENTS

| | | | | | |
|---|---|---|---|---|---|
| 3,013,669 | A | * | 12/1961 | Waite et al. | 211/49 |
| 3,269,547 | A | * | 8/1966 | Chamberlin | 211/11 |
| 3,559,815 | A | * | 2/1971 | Huddleston | 211/184 |
| 3,877,767 | A | * | 4/1975 | Bright | 312/337 |
| 3,978,632 | A | | 9/1976 | Ansted | 52/309 |
| 3,998,069 | A | * | 12/1976 | Kronenberger et al. | 62/288 |
| 4,023,682 | A | * | 5/1977 | Niece | 211/184 |
| 4,416,380 | A | | 11/1983 | Flum | 211/49 |
| 4,423,818 | A | | 1/1984 | Spamer | 211/49 |
| 4,454,948 | A | | 6/1984 | Spamer | 211/49 |
| 4,454,949 | A | | 6/1984 | Flum | 211/49 |
| 4,565,725 | A | | 1/1986 | Spamer | 428/167 |
| 4,651,883 | A | | 3/1987 | Gullett et al. | 211/595 |
| 4,685,574 | A | | 8/1987 | Young et al. | 211/59.2 |
| 4,690,287 | A | | 9/1987 | Fershko | 211/49.1 |
| 4,785,943 | A | | 11/1988 | Deffner | 211/59.2 |
| 4,785,945 | A | | 11/1988 | Rowse | 211/59.2 |
| 4,790,707 | A | | 12/1988 | Magretta | 414/276 |
| 4,801,025 | A | | 1/1989 | Flum | 211/128 |
| 4,886,171 | A | | 12/1989 | Spamer | 211/59.2 |
| 4,890,746 | A | | 1/1990 | Trulaske | 211/59.2 |
| 5,022,535 | A | | 6/1991 | Spamer | 211/59.2 |
| 5,050,748 | A | | 9/1991 | Taub | 211/59.2 |
| 5,088,607 | A | | 2/1992 | Risafi | 211/59.3 |
| 5,097,962 | A | | 3/1992 | Eklof et al. | 211/59.2 |
| 5,197,610 | A | | 3/1993 | Bustos | 211/59.2 |
| 5,228,581 | A | * | 7/1993 | Palladino et al. | 211/153 |
| 5,240,126 | A | | 8/1993 | Foster | 211/59.3 |
| 5,269,447 | A | * | 12/1993 | Gower et al. | 224/42.42 |
| 5,295,591 | A | | 3/1994 | Slater | 211/59.2 |
| 5,301,517 | A | | 4/1994 | Bustos | 62/251 |
| 5,341,945 | A | * | 8/1994 | Gibson | 211/184 |
| 5,379,905 | A | | 1/1995 | Bustos et al. | 211/59.2 |
| 5,411,146 | A | * | 5/1995 | Jarecki et al. | 211/59.2 |
| 5,417,333 | A | | 5/1995 | Flum | 211/59.2 |
| 5,437,380 | A | * | 8/1995 | Peay et al. | 211/184 |
| 5,441,338 | A | | 8/1995 | Kane | 312/408 |
| 5,450,971 | A | | 9/1995 | Boron et al. | 211/134 |
| 5,454,638 | A | | 10/1995 | Bird et al. | 312/408 |
| 5,499,513 | A | | 3/1996 | Bustos | 62/252 |
| 5,531,336 | A | | 7/1996 | Parham | 211/183 |
| 5,584,192 | A | | 12/1996 | Bustos | 62/457.9 |
| 5,607,068 | A | * | 3/1997 | Coretti, Jr. et al. | 211/59.2 |
| 5,624,042 | A | | 4/1997 | Flum et al. | 211/59.2 |
| 5,642,923 | A | | 7/1997 | Meacham et al. | 312/258 |
| 5,645,176 | A | | 7/1997 | Jay | 211/59.2 |
| 5,645,182 | A | | 7/1997 | Miller, Jr. et al. | 211/134 |
| 5,695,077 | A | | 12/1997 | Jay | 211/59.2 |
| 5,775,523 | A | * | 7/1998 | Teringo | 211/184 |
| 5,806,689 | A | | 9/1998 | Mays | 211/59.2 |
| 6,082,557 | A | * | 7/2000 | Leahy | 211/59.3 |

* cited by examiner

*Primary Examiner*—Daniel P. Stodola
*Assistant Examiner*—Khoa Tran
(74) *Attorney, Agent, or Firm*—Holland & Knight LLP

(57) ABSTRACT

A lane divider for fitting to a shelf having front and rear rails, including at least one elongated loop having front and rear ends and a member affixed to each of the front and rear ends of the elongated loop, the member including a face for engaging the front and rear rails, respectively, of the shelf, whereby when the elongated loop is dimensioned to be positioned with the faces of the members respectively engaging the rails.

10 Claims, 3 Drawing Sheets

LANE DIVIDERS FOR COMMERCIAL DISPLAY REFRIGERATORS

BACKGROUND OF THE INVENTION

1. Field of the Invention

This invention relates to commercial display refrigerators having glass doors for allowing viewing of merchandise contained within the refrigerator. More particularly, this invention relates to shelving that is employed within commercial display refrigerators on which the merchandise is placed for viewing by the consumers.

2. Description of the Background Art

Presently, display refrigerators are commonly used in retail stores such as grocery and convenience stores, for refrigerating merchandise such as beverages placed on shelving behind the glass doors allowing the discriminating shopper to view the merchandise while shopping. Once the selection is made, the shopper may then open the glass door and remove the product from the refrigerator.

There exists many different types of shelving. Shelving that is most commonly used for beverages, is tilted forwardly from the back to the front of the refrigerator. Further, such shelving is typically divided into lanes by means of lane dividers, the distances between which are dimensioned so as to accommodate beverages bottled in various type of containers. For example, one lane my be dimensioned for 12 ounce carbonated beverage cans of a particular brand and an adjacent lane for 16 ounce sports drink bottle.

As may be appreciated, as the consumer removes one of the beverages from a particular lane, the remaining beverages slide forwardly by gravity to the front of the shelf. Hence, all of the lanes remain "fronted" with their respective beverages, thereby presenting an attractive presentation to the consumer.

Some lane dividers are formed of a rigid solid material that is injection molded or theretofore with pre-dimensioned lanes for standard sizes of beverages. These rigid lane dividers are then placed on top of the shelf or are integrally formed with the shelf itself. Unfortunately, most of these rigid lane dividers are not adjustable to accommodate different kinds of beverages and therefore are too restrictive to changes in merchandising plans that may occur from time to time. Others include divider plates that can be repositioned to a degree to form lanes. Representative rigid lane dividers are disclosed in U.S. Pat. Nos. 5,531,336, 5,197610, 5,417,333, 5,097,962, 5,050,748, 5,022,535, 4,801,025, 4,785,943, 4,785,945, 4,690,287, 4,454,948, 4,423,818, 5,088,607, 4,416,380 4,565,725, 4,454,949, 5,295,591 and 5,645,176, the disclosures of which are hereby incorporated by reference herein.

More contemporary lane dividers comprise wire-formed lane dividers that attach to the shelf by various means. Some attachments are fixedly-attached whereas others are adjustable. A representative wire lane divider is disclosed in U.S. Pat. No. 4,890,746, the disclosure of which is hereby incorporated by reference herein.

Wire lane dividers are often employed with a ridged "slick sheet", typically composed of rigid plastic materials with friction-reducing compounds embedded in it, that is placed on the shelf. The beverages are then placed on top of the slick sheet in the desired lanes. The slick sheet more readily assures that the beverages are gravity-fed to slide down their respective lanes to the front of their shelf without sticking.

Unfortunately, wire lane dividers, particularly those that are adjustably-mounted, have a tendency to slide sideways, thereby squeezing the beverages in an adjacent lane and precluding them from sliding forward. Hence, there exists a need in the industry for wire lane dividers that are adjustable to various lane widths yet preclude sideways movement during use.

Therefore, it is an object of this invention to provide an improvement which overcomes the aforementioned inadequacies of the prior art devices and provides an improvement which is a significant contribution to the advancement of the shelving art in the field of commercial display refrigerators.

Another object of this invention is to provide a lane divider that may that be utilized in connection with various types of commercial display refrigerators.

Another object of this invention is to provide a lane divider that is adjustable to define differently-sized lanes so as to accommodate the shelving display of differently-sized beverages that are lined-up in their respective lanes on the shelf and are gravity-fed forwardly toward the front of the refrigerator display.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a wire-formed lane divider for commercial display refrigerators. The lane divider of the invention is designed for adjustable use with conventional wire shelving including those employing slick sheets. Thus, the lane divider may be easily installed in conventional wire shelving at different lane widths so as to accommodate differently-sized beverages as may be desired for various merchandising plans. Further, the design of the lane divider of the invention precludes sideways shifting, thereby obviating the squeezing of the beverages in an adjacent lane that would otherwise occur upon such sideways shifting of the lane divider.

The lane divider of the invention, being formed by wire technology, is inexpensive to manufacture due to low tooling and material costs. Moreover, the employment of wire in the design permits the removal of the slick sheet for cleaning and to otherwise allow debris to fall through the shelving to the floor where it can be more easily cleaned up.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

DETAILED DESCRIPTION OF THE PREFERRED EMBODIMENT

Figure 1:
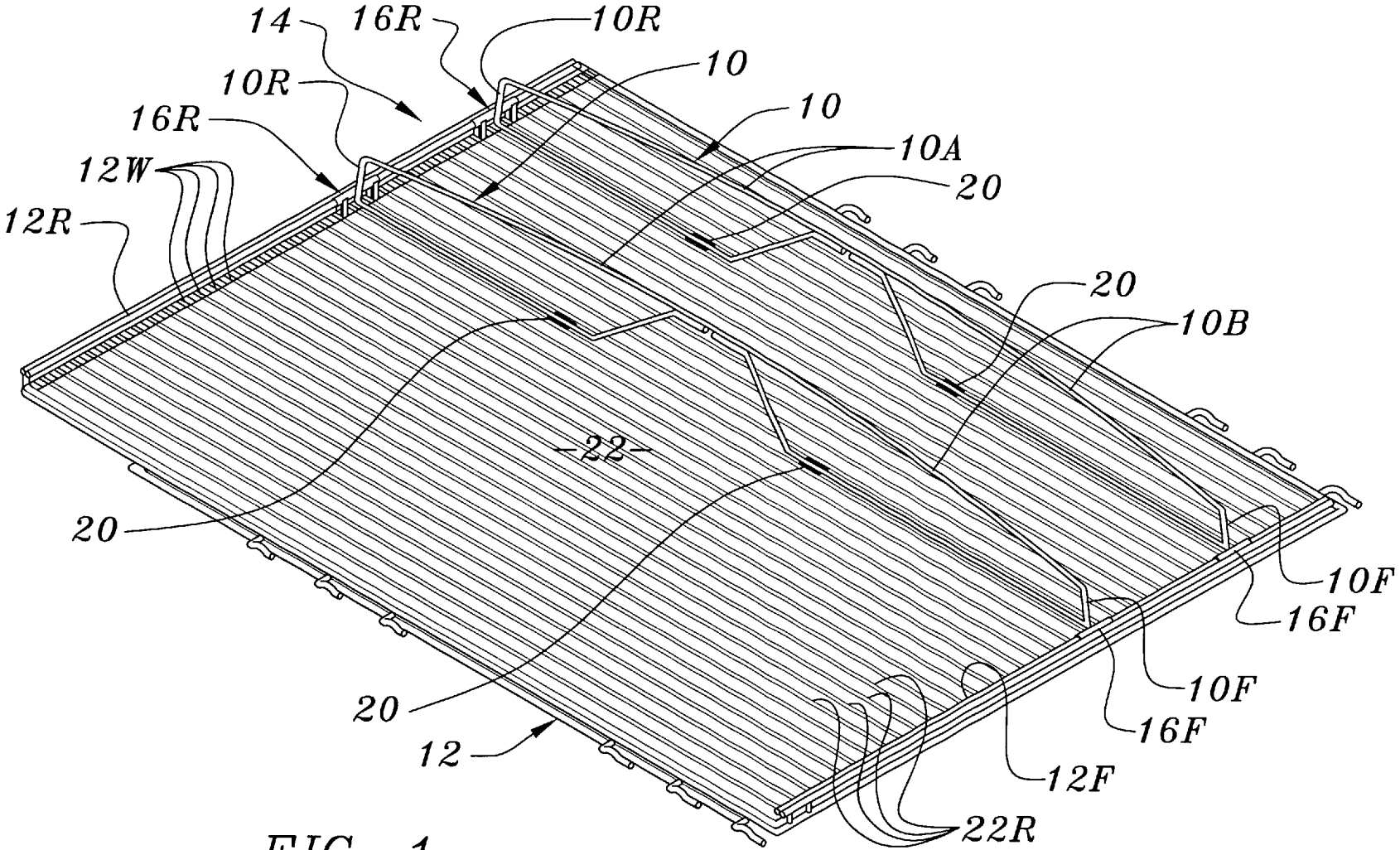
FIG. 1 is perspective view of a shelving system employing the lane divider of the invention.
Figures 2, 3, 4, 5, 6:
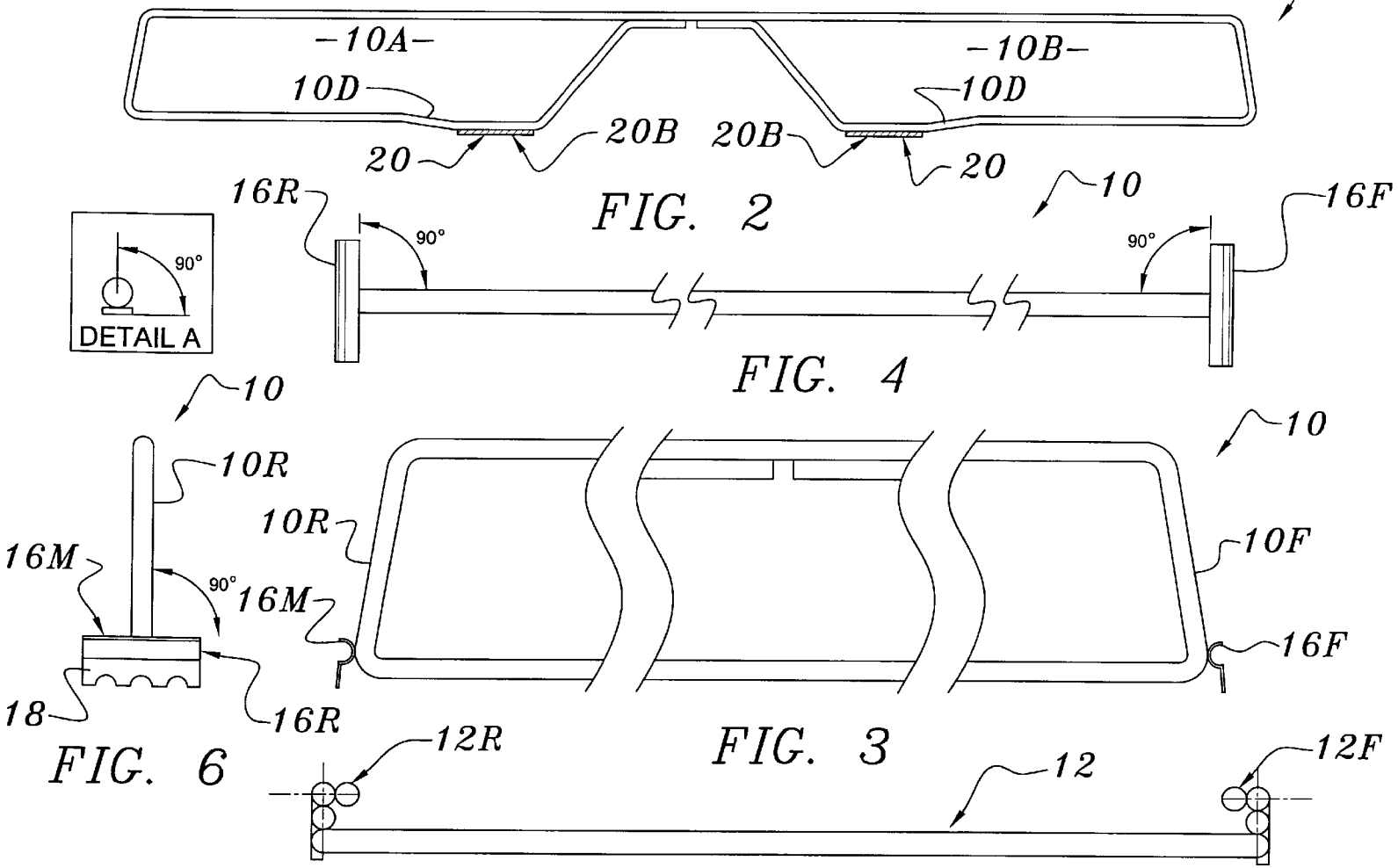
FIG. 2 a side view of the lane divider of the invention.
FIG. 3 is an enlarged view of FIG. 2.
FIG. 4 is a top view of FIG. 3.
FIG. 5 is a longitudinal view of a wire shelf showing the end rails thereof.
FIG. 6 is an end view of FIG. 3.
Figure 8:
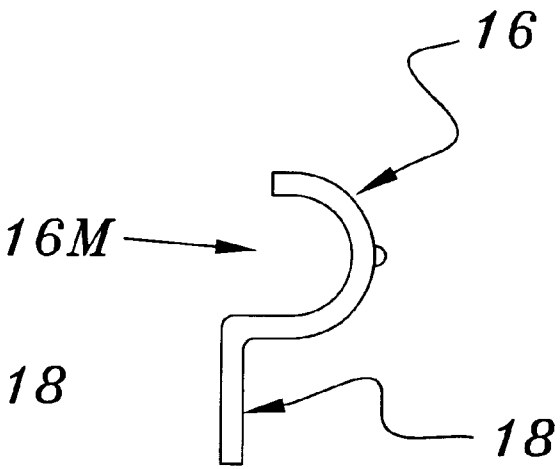
FIG. 8 is side view of FIG. 7, Similar reference characters refer to similar parts throughout the several views of the drawings.
Figure 7:
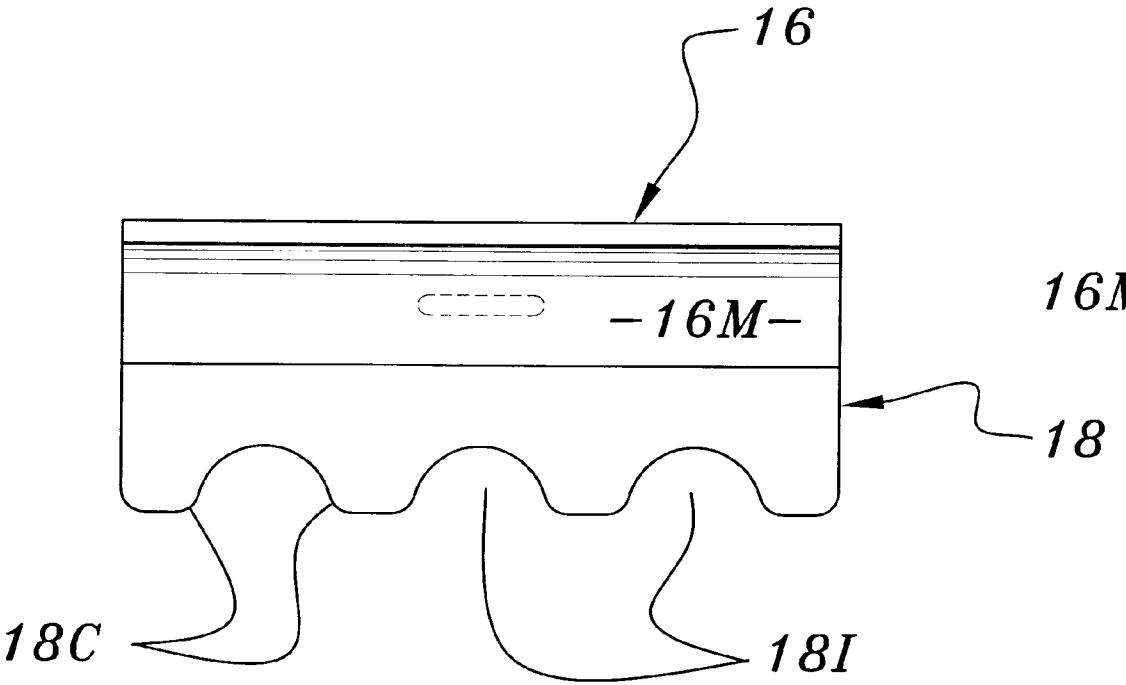
FIG. 7 is an end view of the C-shaped member.

The wire-formed lane divider 10 of the invention comprises an elongated wire loop configuration (preferably two elongated wire loops 10A & 10B as shown) that is intended to be adjustably positioned vertically above a shelf 12 to define lanes 14 for the beverages (not shown) that are loaded into the lanes 14.

More particularly, the lane divider 10 of the invention includes a C-shaped member 16 affixed to the front 10F and rear 10R ends of the lane divider 10 with the mouth 16M of the C-shaped member 16 facing forwardly and rearwardly, respectively. The length of the lane divider 10 is appreciably greater than the distance between opposing front 12F and rear 12R wire rails of the shelf 12 such that the lane divider 10 can be slightly bent or "sprung" whereupon the C-shaped members 16 are snap-fitted between the rails 12F & 12R with the respective mouths 16M of the C-shaped members 16 engaged partially about the rails 12F & 12R.

The lane divider 10 of the invention further includes a downwardly-extending rake member 18 having an inverted castlelated configuration with castlelations 18C and indentations 18I. The castlelations 18C and indentations 18I preferably comprise several in number (e.g, 2–6) that are equally spaced apart so as to be aligned with the standard spacings of wires 12W of the shelf 12 itself. Being aligned, the castlelations 18C engage into such spacings of shelf wires 12W and the indentations 18I ride over the shelf wires 12W. The lane divider 10 is therefore fixed in a precise position along the width of the shelf rails 12F and 12R.

The lane divider 10 further includes at least one, preferably two, feet 20 affixed to the bottom portion of its loop(s) 10A & 10B for fitting within the spacing between the shelf wires 12W or between the ridges 22R of the slick sheet 22 if one is employed.

Preferably, feet 20 each comprises a flat bottom 20B with relatively sharp longitudinal edges that engage the bottom longitudinal corners of the ridges 22R of the slick sheet 22 as they are seated therebetween, thereby preventing the feet 20 from riding over the ridges 22R. Also preferably, the bottom portion of each of the loops 10A & 10B further includes a downwardly-dipping bend 10D. The bend 10D more adequately assures that the feet 20 will engage the flat spacing between the ridges 22R of the slick sheet 22 and, if a slick sheet 22 is not employed, the bend 10D causes the feet 20 to fit through the spacing between the wires 12W of the shelf 12. Therefore, in both implementations, sideways shifting of the lane divider 10 is prevented.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A shelf including a lane divider, comprising in combination:

a wire shelf with shelf wires defining spaces therebetween and having front and rear rails extending above and across a front edge and a rear edge of the shelf, respectively;

at least one elongated loop having front and rear ends; and members respectively affixed to said front and rear ends of said elongated loop, said members each including a face for engaging the front and rear rails, respectively, of the shelf, each said members further including a downwardly extending rake portion for engagement with the shelf wires;

a foot affixed to a bottom of said elongated loop between the rake portions;

whereby said elongated loop may be positioned with said faces of said members respectively engaging the rails.

2. The lane divider as set forth in claim 1, wherein said rake portion of said members further includes at least one castlelation and at least one indentation for engagement with the shelf wires.

3. A shelf including a lane divider, comprising in combination:

a wire shelf with shelf wires defining spaces therebetween and having front and rear rails extending above and across a front edge and a rear edge of the shelf, respectively;

a slick sheet with spaces and ridges;

at least one elongated loop having front and rear ends;

members respectively affixed to said front and rear ends of said elongated loop, said members including a face for engaging the front and rear rails, respectively, of the shelf, each of said members further including a downwardly extending rake portion for engagement with the shelf wires;

a foot affixed to a bottom of said elongated loop between the rake portions for engagement with said slick sheet; and whereby said elongated loop may be positioned with said faces of said members respectively engaging the rails.

4. The lane divider as set forth in claim 3, wherein said foot includes bottom corners.

5. The lane divider as set forth in claim 3, wherein said rake portion of said members further includes at least one castlelation and at least one indentation for engagement with the slick sheet.

6. A shelving system, comprising in combination:

a wire shelf with shelf wires defining spaces therebetween and having forward and rear rails extending above and across a front edge and a rear edge of the shelf, respectively; and a plurality of lane dividers for fitting to said shelf, said lane dividers including at least one elongated loop having front and rear ends; and members respectively affixed to said front and rear ends of said elongated loop, said members each including a face for engaging said front and rear rails, respectively, of said shelf, each said members further including a downwardly extending rake portion for engagement with the shelf wires;

a foot affixed to a bottom of said elongated loop between the rake portions;

whereby said lane dividers may be positioned with said faces of said members respectively engaging said rails.

7. The shelving system as set forth in claim 6, further including a slick sheet with spaces and ridges positioned on said shelf and wherein said foot then engages said spaces of said slick sheet instead of said spaces of said shelf.

8. The shelving system as set forth in claim 7, wherein said foot includes bottom corners.

9. The shelving system as set forth in claim 6, wherein rake portion of each of said members further includes at least one castlelation and at least one indentation for respective engagement with said spacings and said shelf wires.

10. The shelving system as set forth in claim 6, wherein said bottom of said elongated loop further includes a bend to which said foot is affixed.

* * * * *